United States Patent [19]

Carmichael

[11] Patent Number: 5,005,224

[45] Date of Patent: Apr. 9, 1991

[54] TOILET BOWL SILENCER DISH

[76] Inventor: William M. Carmichael, 555 Fillmore Ave. #603, Cape Canaveral, Fla. 32920

[21] Appl. No.: 451,439

[22] Filed: Dec. 15, 1989

[51] Int. Cl.[5] ..... E03D 9/00

[52] U.S. Cl. ..... 4/300.3; 4/DIG. 5

[58] Field of Search ..... 4/300.3, 309, 453, 457, 4/231, DIG. 5

[56] References Cited

U.S. PATENT DOCUMENTS

| | | | |
|---|---|---|---|
| 680,179 | 8/1901 | Schoneman | 4/231 |
| 1,067,472 | 7/1913 | Creed | 4/231 |
| 1,091,265 | 3/1914 | Wohlander | 4/231 |
| 2,407,005 | 9/1946 | Haley | 4/300.3 X |
| 2,592,040 | 4/1952 | La Hue | 4/DIG. 5 X |
| 3,350,722 | 11/1967 | Moreschini | 4/300.3 |
| 3,486,172 | 12/1969 | Gleichert | 4/300.3 |
| 3,614,790 | 10/1971 | Billingsly et al. | 4/300.3 |
| 3,723,998 | 4/1973 | Wehr | 4/300.3 |
| 4,050,101 | 9/1977 | Logue | 4/300.3 |
| 4,062,070 | 12/1977 | Prince | 4/300.3 |
| 4,612,676 | 9/1986 | Whitman | 4/300.3 |
| 4,866,793 | 9/1989 | Luedtke et al. | 4/300.3 |

FOREIGN PATENT DOCUMENTS

| | | | |
|---|---|---|---|
| 241344 | 10/1925 | United Kingdom | 4/231 |

*Primary Examiner*—Henry J. Recla
*Assistant Examiner*—Robert M. Fetsuga

[57] ABSTRACT

The Toilet Bowl Silencer Dish is an accessory for the common household bathroom toilet bowl. It allows the adult male the capability to stand and use the toilet bowl without splashing urine or generating audible noise. A glazed ceramic dish is attached to a counterbalance and draped over the rim of the toilet bowl. Monofiliment line is looped through specially designed rings molded on the back side of the dish. This monofiliment twine is then looped through the counterbalance. The attached assembly will fit any toilet bowl shape. The dish hangs in a vertical position offering a concave target to the user. By directing his column of liquid, the user is able to avoid direct disruption of the noise generating toilet bowl water surface. The concaved shape of the dish blends with the rotating current of the swirling flush water and does not interfere with or obstruct the flushing action of the toilet. Target arcs are molded into the top of the Toilet Bowl Silencer Dish to assist the user in its most advantages use. Specially designed hang rings, in concert with splash fins on the back of the dish, assure that the dish will stay in an area of non-use within the toilet bowl and maintain an optimal angle. The counterbalance is in the shape of a handle to remind the owner that the Toilet Bowl Silencer Dish is easily removed for cleaning purposes. When the assembly is again draped over the toilet bowl rim, the designed balance of the dish will automatically assume a predetermined orientation.

14 Claims, 9 Drawing Sheets

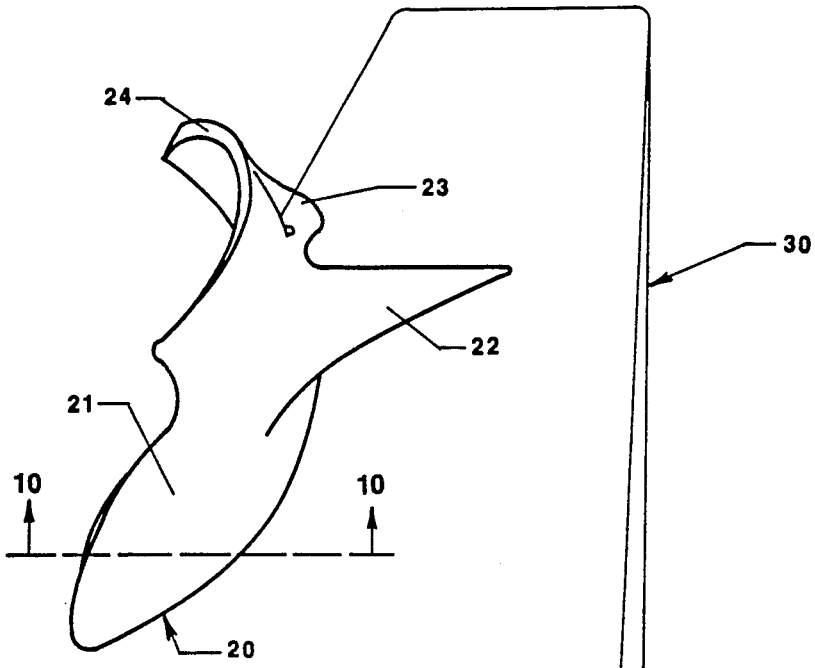
FIG 5A
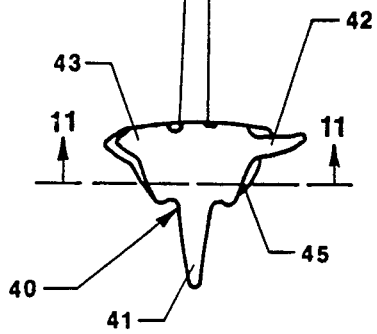
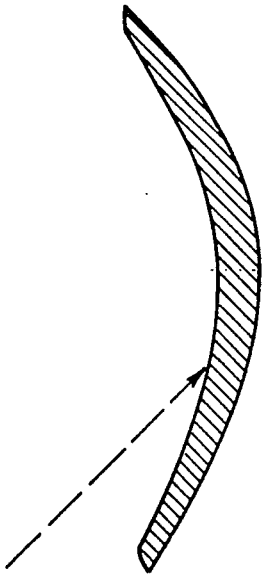
FIG 10
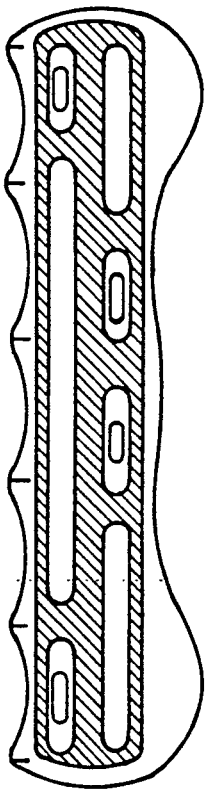
FIG 11

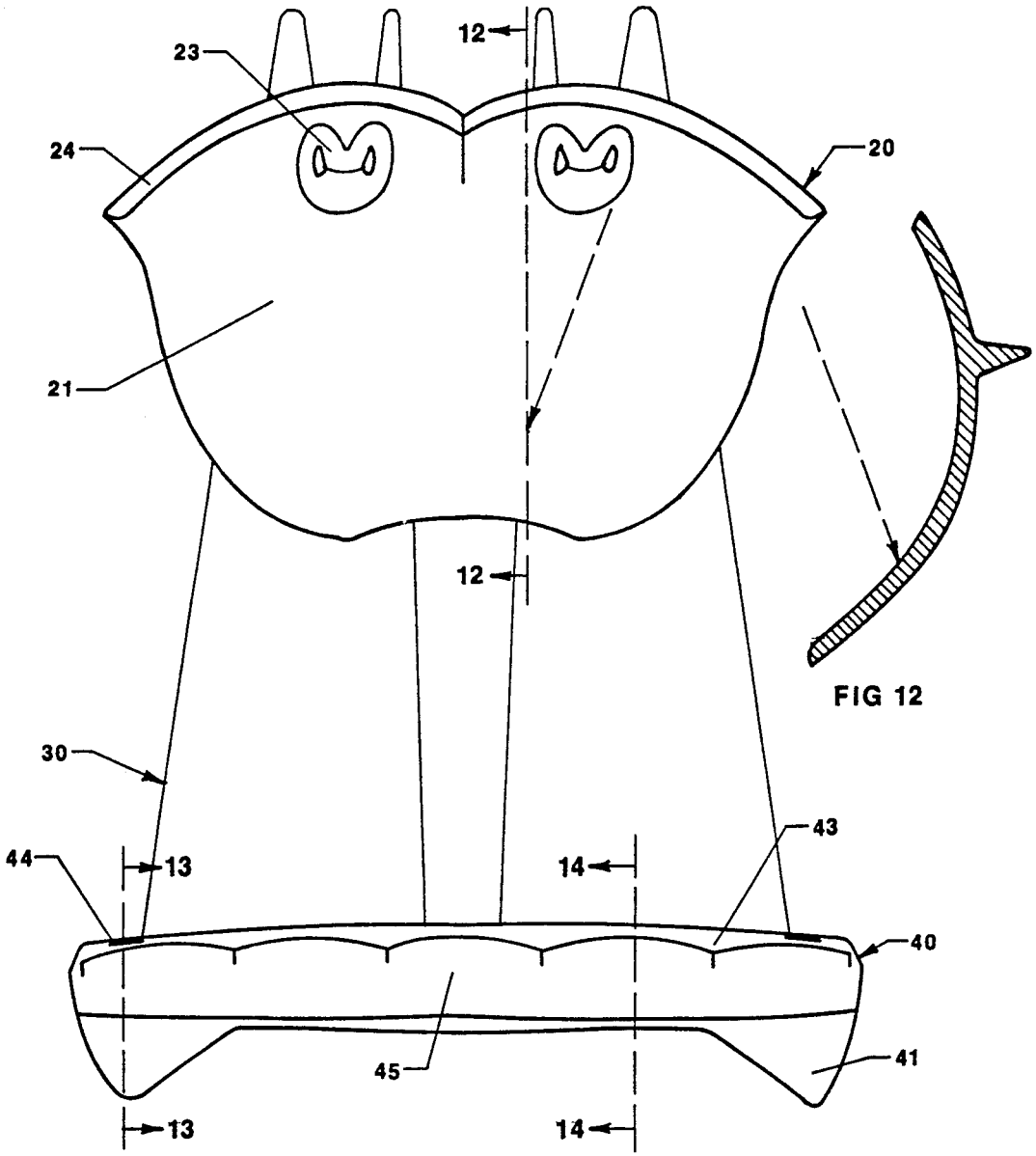
FIG 12
FIG 5B
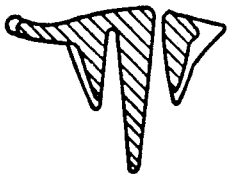
FIG 13
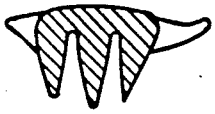
FIG 14

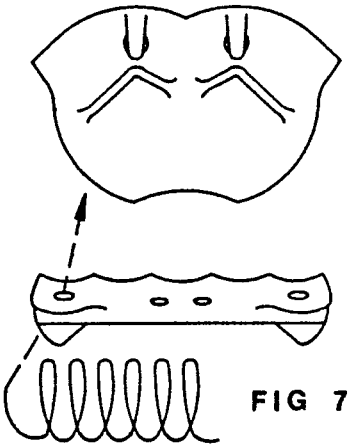
FIG 7A
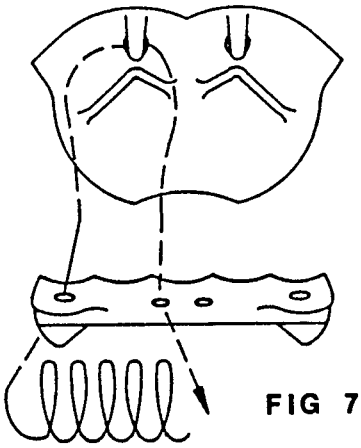
FIG 7B
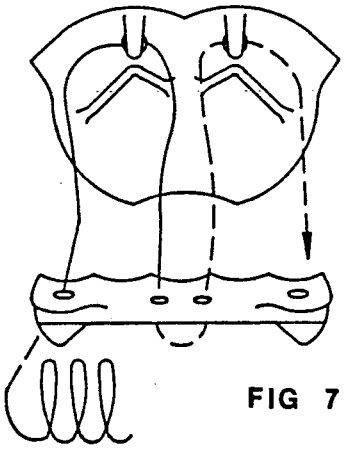
FIG 7C
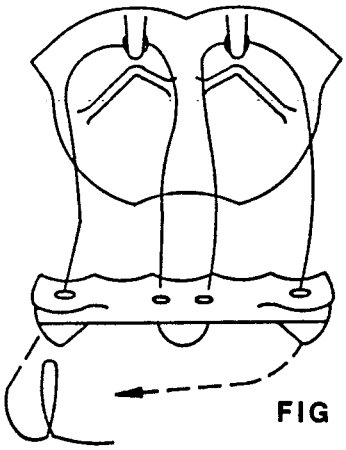
FIG 7D
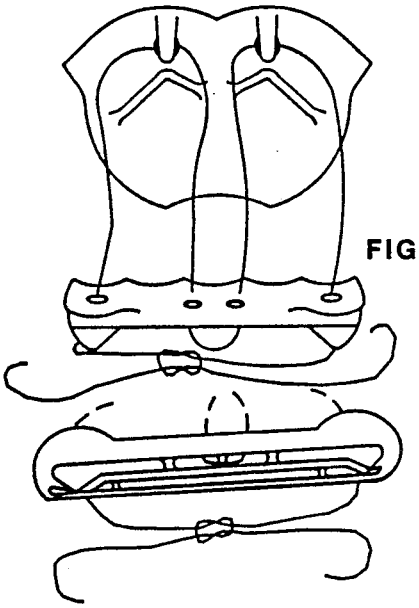
FIG 7E
FIG 7F
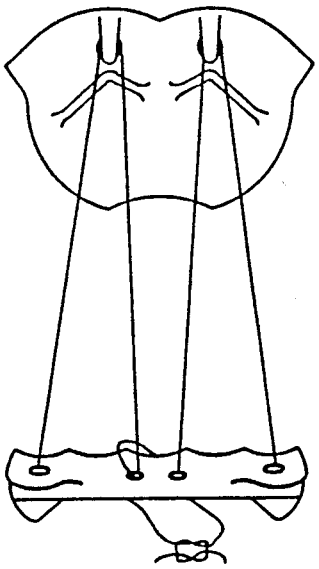
FIG 7G

TOILET BOWL SILENCER DISH

BACKGROUND—FIELD OF INVENTION

The owner of a one-hundred-thousand dollar condominium unit asked if something could be done about the noise that the gentleman upstairs makes when he uses his toilet. He was referring to the sound of liquid hitting the toilet water in the bathroom of the unit directly above. This tinkling sound is carried along the plumbing pipes through walls and ceilings. The question was directed at a board of directors at a condominium association meeting. Everyone said that they were familiar with the irritating sound and all responded that absolutely nothing could be done about it.

A person who is extremely cognizant of this problem could observe the attempts of some toilet manufacturers to design a toilet bowl that acts as both a urinal and a seatable pot. Designs that try to offer the extra surface provided by a urinal fail to accomplish their objective. This is because the water level of the toilet bowl is not accurately controllable. In addition, as the shape of the toilet bowl becomes less hemispherical the flush becomes less effective.

The source of the noise is a falling column of liquid hitting the surface of standing water. The surface vibrates because the natural surface tension tries to keep the liquid water molecules together. If the flowing column of liquid was directed at a non-vibrating surface there would be no noise.

The common household bathroom toilet is a magnificent device which performs frequently and repeatedly without failure. It usually lasts longer than any other piece of equipment in the modern home. Past attempts to redesign the toilet bowl have not resulted in a resolution to the noise problem. The exact surface level of the standing water in the bowl is not constant and cannot be individually adjusted. Because of this, a definite unsubmerged non-liquid surface area of the inner bowl cannot be assured. This is the primary reason that toilet designers have been unable to guarantee a non-liquid surface.

There are two reasonable ways to avoid the noise of urine splashing into the bowl of water. One is to install a commercial, public, type urinal in every bathroom. Everyone knows that these devices offer surfaces that don't vibrate sound waves when hit with a flowing column of liquid. The second solution would be the act of the gentleman sitting down on the toilet seat. This reduces the gravitational acceleration which adds energy to the liquid stream and suppresses the modular build up of the falling droplets. The first solution would require the size of the bathroom to be increased by more than twice that of normal space allotments. The second solution fails because of habit and convenience. Since it is natural and comfortable for gentlemen to remain standing, it must be expected that men will not sit. Thus the common home toilet must also serve as a urinal.

OBJECTS AND ADVANTAGES

An accessary that goes with the toilet bowl and that acts as a non-vibrating target would solve the noise problem. Such an accessary should fit inside the toilet bowl so that the flush could be used the help clean it. Such a device must be independent of significant variations in the water level. In addition, this accessary must be sanitary, not interfere with the flush or any solid waste, and must be stable so that it does not wobble, shift around, or fall out of position. Most inportant, this device must have a shape that will direct all of the falling liquid into the toilet bowl. In order to be commercially feasible, this accessary must fit and fasten to all of the differently shaped toilet bowls distributed by the many manufacturers. Also, a device for this particular purpose should be easy to install without having to assemble complicated parts. Ideally, the device should be self adjusting. This would allow for easy removal and re-installation for cleaning. Because the problem that this device solves is not severally detrimental to a congenial social life, this accessary must be simple and inexpensive.

A suitable location inside the toilet bowl must be defined. To accomplish this requires a brief analysis of the human anatomy and an observation that the bowl is shaped to function as a flush basin. One can conclude that the human anatomy is not shaped exactly like a toilet bowl and a toilet bowl is not shaped exactly like the human anatomy. From this observation the term "volume of non-use" is defined. See FIGS. 3A, 3B, and 3C on sheet #3 showing the three elevations of the "volume of non-use" cross hatched. The "volume of non-use" is that volume inside the common household bathroom toilet bowl where an object could be placed without interferring with the flushing action or the functioning human anatomy. An accessary could reside inside this volume without disturbing or disrupting normal use of the toilet.

The accessary is made of glazed ceramic clay similar to the toilet bowl and is called the Toilet Bowl Silencer Dish. The density of the dish shaped device lends to its stability while swirling water passes across it. See FIG. 2. It is not fastened to the rim of the toilet bowl but draped across the rim by use of an attached counterbalance (40). See FIG. 1. A length of waterproof twine (30) is tied to the Dish assembly (20) and then tied to a handle shaped ceramic counterbalance (40) of approximately the same weight as the Dish. The counterbalance hangs outside of the toilet bowl but usually out of sight as it rests close to the underside of the bowl. See FIGS. 4A and 4B on Sheet #3. The Twine (30) loops twice through the dish and twice through the counterbalance resulting in four, almost invisible, lines laying across the rim. The twine loops through two rings (23) in the dish which are molded such that the dish will always hang at the same angle with a vertical plane. (See FIGS. 6A thru 6D) Notice that, generally, the concave shape of the dish blends with the inside concavity of the toilet bowl. It rests on either side, as opposed to the front side or back side, of the toilet bowl. This area has been defined as the "volume of non-use". (See FIGS. 3A, 3B, and 3C on Sheet #3) That is, the dish is not in the way of the normal use of the toilet. The inside concave surface of the dish provides a target for a falling column of liquid that is positioned 8 cm (or 3 inches) inside and 8 cm (or 3 inches) below the outside rim of the toilet bowl. (See FIGS. 1 and 2 on Sheets #1 and #2).

The general shape of the dish (20) is such that it can be inserted into a toilet bowl without interrupting the flush. The dish remains still during the rise and fall of the swirling flush water. This is because the relative density of the ceramic material prevents it from being lifted by the rising water. Then, since its shape agrees with the direction of the rotating water current, it is not pushed into a different position by horizontal flow.

The Toilet Bowl Silencer Dish has two slanted circular arcs molded in the top edge of the dish assembly. (See FIG. 2). These arcs (24) imply to the user that there is a 10 cm (or 4 in.) diameter circular target oriented at a specific angle to the user. (See FIG. 1) This angle, when perpendicular to the falling column of liquid, will cause the stream to strike the dish at no greater than 55 degrees to the tangent plane at the point of contact. (See FIGS. 5B and 12) FIG. 12, on sheet #5, is a sectional view of the dish at a vertical plane through the point of contact of the liquid and the dish surface. Also see FIG. 10 on sheet #4 for the trajectory in the horizontal plane. The result of this angular design is that all deflected droplets will be directed toward the center of the toilet bowl. Actually, the majority of the incoming liquid column spreads out over the dish surface and spills quietly into the toilet bowl water. The arcuated dish shape also agrees with the rotational direction of the draining toilet water and does not interfere with the flushing action or with any solid waste that is carried in the flow. (See FIG. 10 on Sheet #4) Because of the round bottom edge and the thinness of the dish, solid waste is carried past without snagging. (See FIGS. 5B and 5D on sheets #5 and #7)

Fins called splash fins (22) help scatter water over the back surfaces of the dish and keep the dish stable by bracing its weight against the upper inside surface of the toilet bowl. (See FIGS. 5A, 5C, and 5D) The splash fins are shaped to withstand the transverse hydrodynamic load of a high water level flush. The bracing action of the splash fins is shown in FIGS. 6A thru 6D.

The counterbalance (40) weighs approximately the same as the dish assembly (20). See FIG. 1. In addition to providing the source of tension for the twine holding the dish in place, the counterbalance provides five other functions. It provides four holes (44) such that one loop of twine threaded through the two hang rings will allow equal tension on both ends of the dish. It keeps the the twine separated at angles so that it does not become tangled. It is designed with a unique center of gravity in order to hang in a stable position. It provides a shape that allows a safety loop to be tied so that the failure of one knot in the twine (slick waterproof line) will not cause the dish assembly to fall away from the counterbalance. It acts as an easily graspable handle to pick up the dish assembly so that the cleaning person does not have to reach a hand inside the toilet bowl. (See FIGS. 5A thru 5D on Sheets #4 thru #7) Also, the counterbalance should be sanitary and easily cleanable. Since it too is made of glazed ceramic clay, it is easily cleaned and does not possess surfaces where germs can collect.

The waterproof twine (30) consists of 142 cm (56 in) of eight pound test monofiliment like the type purchased in a sport fishing bait store. The twine is strung as illustrated in FIGS. 7A thru 7G on Sheet #9.

DESCRIPTION OF DRAWINGS

FIG. 1 is on sheet #1.

FIG. 2 is on sheet #2.

Sheet #3 displays two related concepts. (Again, the toilet seat is removed.)

Figure 3A:
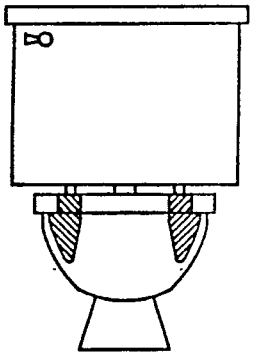
Figure 3B:
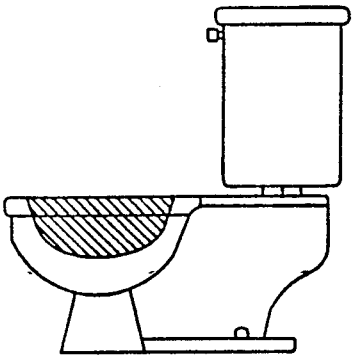
Figure 3C:
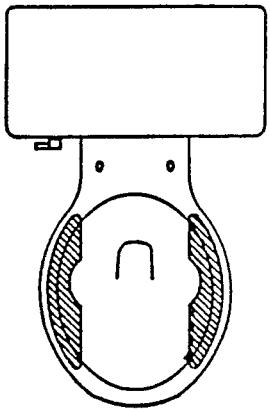

FIG. 3 displays the definition of the "Volume of non-use" which must be shown from the three elevations. The "volune of non-use" is crossed hatched.

Figure 4A:
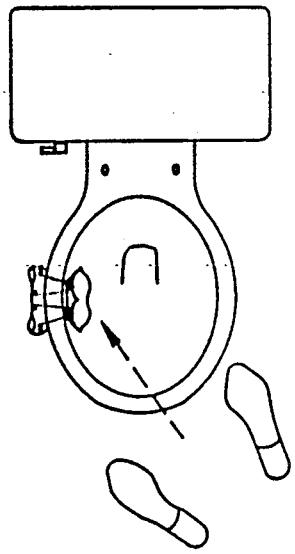
Figure 4B:
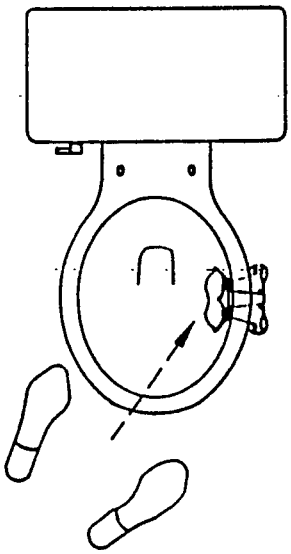

FIG. 4 shows the utilization of the "volume of non-use" by illustrating the two possible installations and how they should be addressed.

FIG. 5A is the side elevation of the Dish Assembly (20), the Twine (30), and the Counterbalance Assembly (40). It also shows a sectional view of each assembly. FIG. 5A is located on sheet #4.

FIG. 5B is the front elevation with one sectional view of the Dish Assembly and two sectional views of the Counterbalance Assembly. FIG. 5B is located on sheet #5. The vertical section cutting the dish is located in a plane through the optimal target area on the dish (21). Because of this, a dashed arrow is included which represents the trajectory of the falling liquid.

Figure 5C:
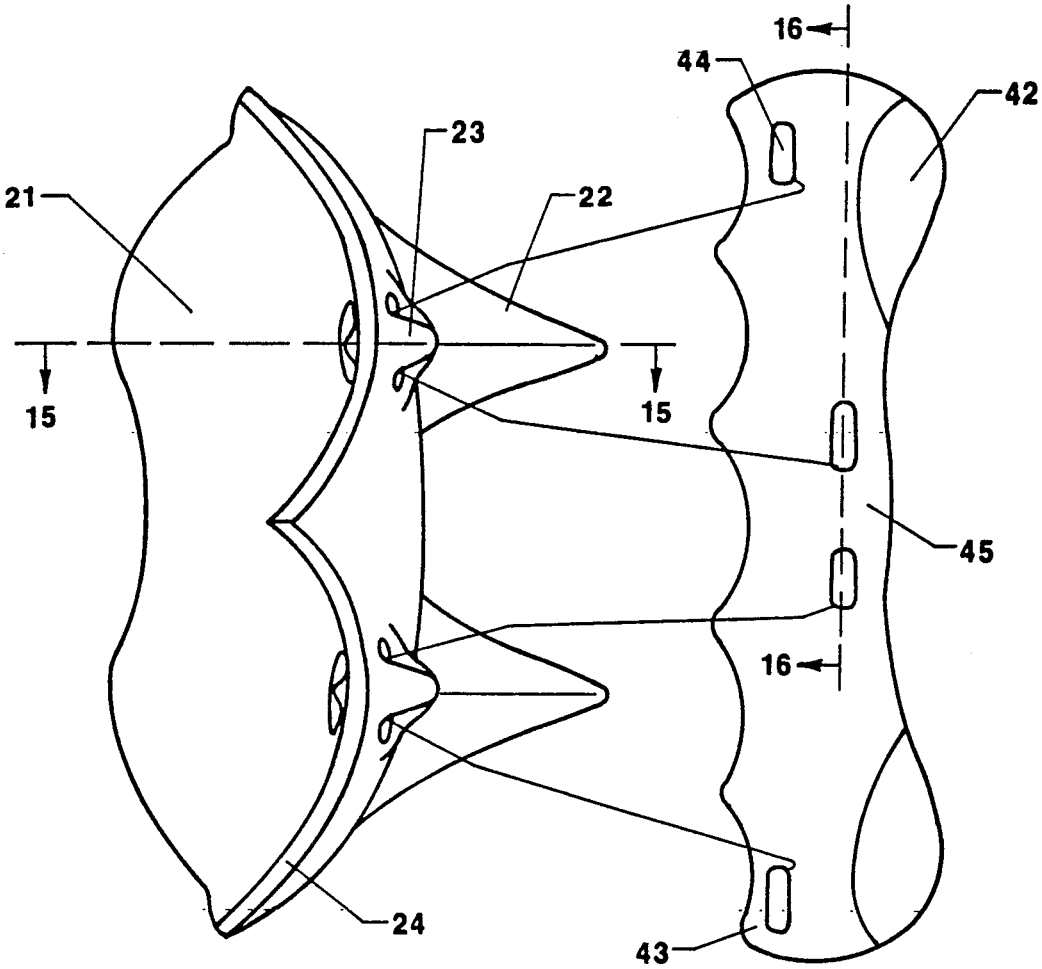

FIG. 5C is the top elevation with one sectional view of the Dish Assembly and one partial sectional view of the Counterbalance Assembly. FIG. 5C is located on sheet #6.

Figure 5D:
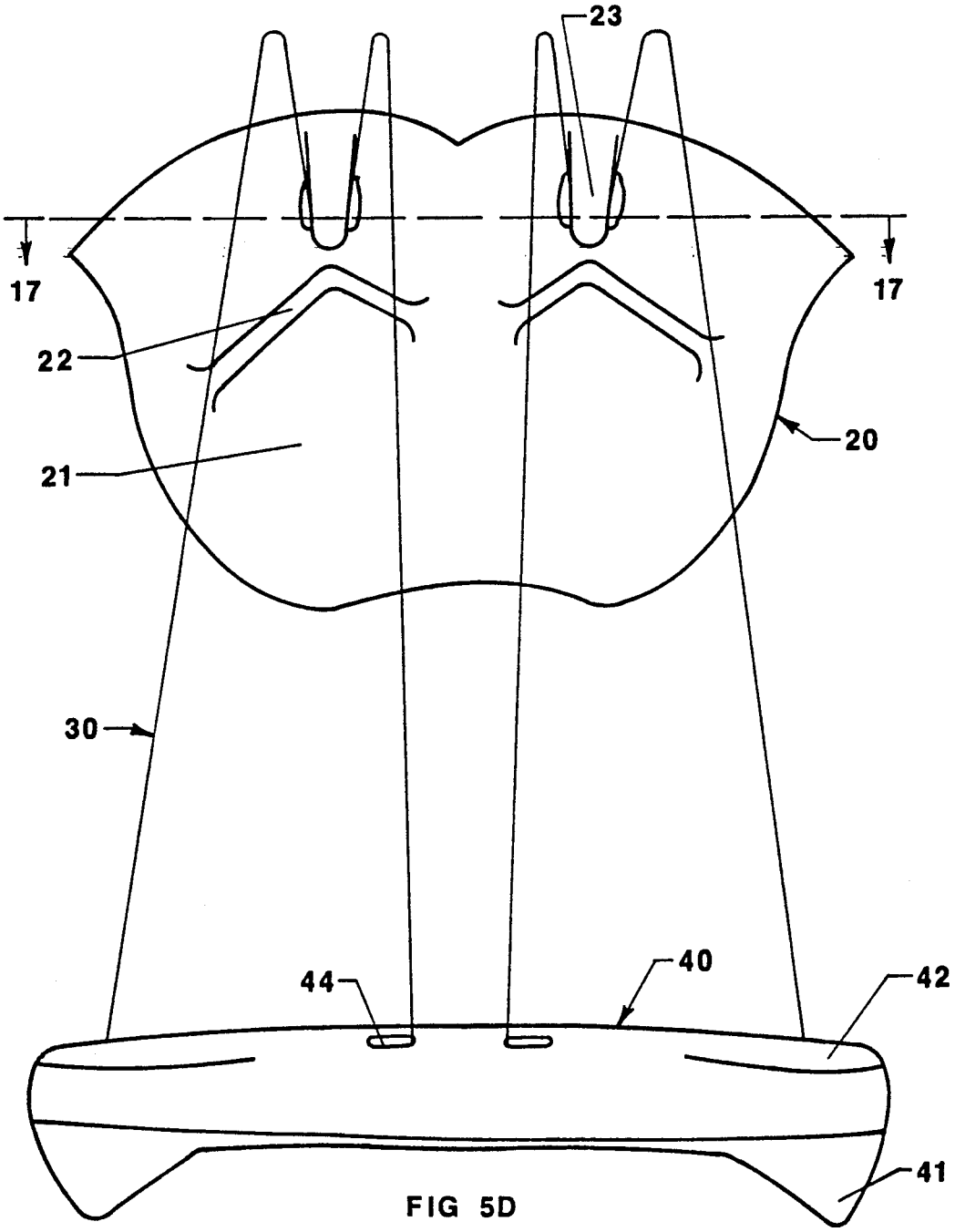

FIG. 5D is the rear elevation with one sectional view of the Dish Assembly (FIG. 17) which dominates the bottom of the page. FIG. 5D is located on sheet #7.

FIG. 6 is located on Sheet #8 and illustrates four different mounting possibilities. The toilet bowl sections are crossed hatched and the counterbalance has been omitted.

Figure 6A:
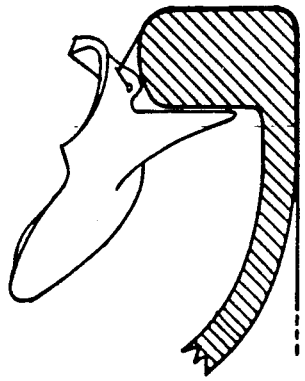

FIG. 6A shows an unusual drain rim overhang sectional that requires the hang rings to work in conjunction with the splash fins to establish a horizontal brace.

Figure 6B:
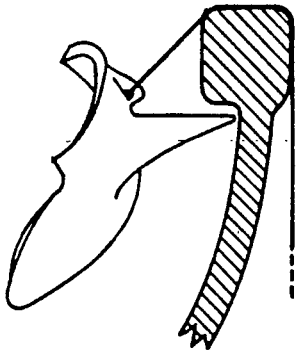

FIG. 6B shows a narrow drain rim section that requires a 45 degree slope of the twine.

Figure 6C:
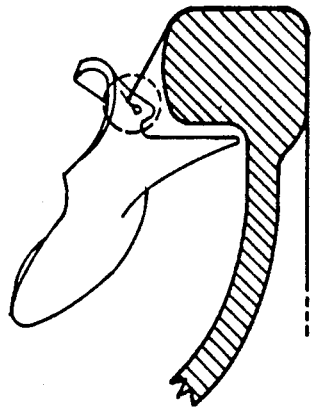

FIG. 6C shows the most commonly expected toilet bowl drain rim shape. This drawing presents a magnified view of the hang ring partially hidden.

Figure 6D:
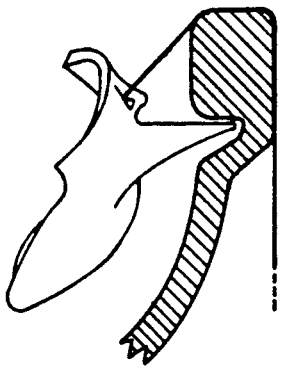

FIG. 6D shows how the design of the splash fins allow the Toilet Bowl Silencer Dish to fit unusual toilet bowl designs.

Figure 6F:
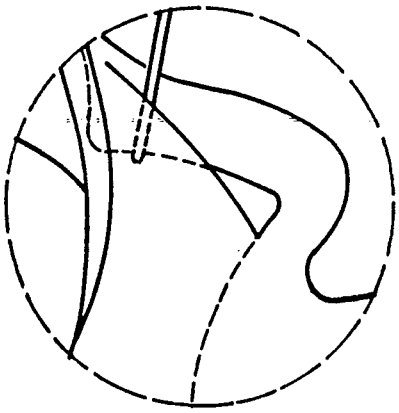
Figure 6E:
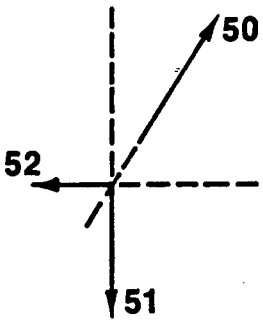

FIG. 6E is a vector diagram showing the three vectors and their virtual extensions to the point of intersection.

FIG. 6F is the magnified circled hang ring of FIG. 6C.

FIG. 7 is a sequnce of steps in stringing the twine.

FIG. 7A shows step 1 with an unstrung coiled twine positioned below the counterbalance. The broken line with the arrow shows the direction that the leading end of the twine will follow toward the backside of the dish.

FIG. 7B continues.

FIG. 7C continues.

FIG. 7D continues.

FIG. 7E shows the first square knot properly positioned.

FIG. 7F shows the proper position of the first square knot from the bottom side of the counterbalance.

FIG. 7G shows the saftey loop strung through one of the central twine slots. This also illustrates the relative size of the safety loop and the second square knot.

FIG. 10 shows a sectional view of the dish as viewed from the bottom. It is a horizontal section which is cut along line 10—10 of FIG. 5A through the optimal target area. Thus it contains the trajectory of the falling liquid column as represented by the dashed arrow. FIG. 10 is located on Sheet #4.

FIG. 11 shows a sectional view of the counterbalance as viewed from line 11—11 of FIG. 5A. FIG. 11 is located on sheet #4.

FIG. 12 shows a vertical section of the Dish as seen along line 12—12 of FIG. 5B. It is located on sheet #5.

FIG. 13 shows a vertical section of the Counterbalance as seen along line 13—13 of FIG. 5B at a point where a twine slot is located. FIG. 13 is on sheet #5.

FIG. 14 shows a vertical section of the Counterbalance as seen along line 14—14 of FIG. 5B. FIG. 14 is located on sheet #5.

Figure 15:
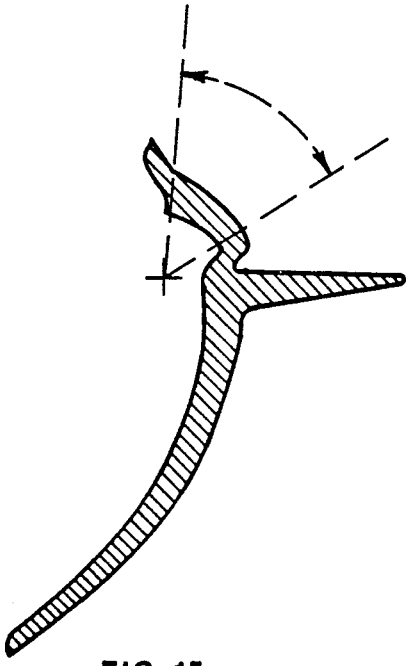

FIG. 15 shows a vertical section seen along line 15—15 of FIG. 5C with phantom lines illustrating the range of twine positions.

Figure 16:
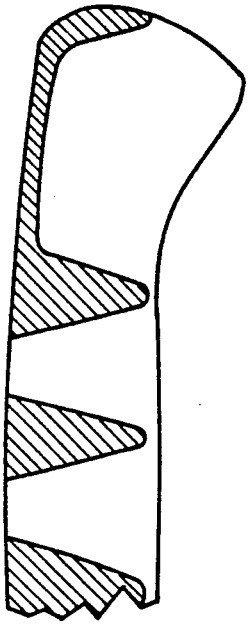

FIG. 16 shows a side sectional of the counterbalance as seen along line 16—16 of FIG. 5C.

Figure 17:
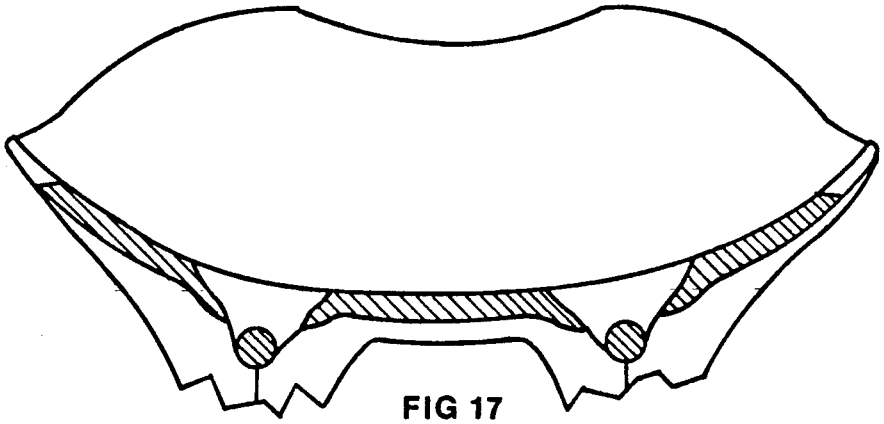

FIG. 17 shows a sectional which is cut horizontally along the line 17—17 of FIG. 5D through the hang rings. The splash fins are broken off but are the same elevation as illustrated in FIG. 5C. FIG. 17 is located on sheet #7.

LIST OF REFERENCE NUMBERS

20 Dish Assembly
21 arcuated disc
22 splash fin (2)
23 hang ring (2)
24 target arc (2)
30 Twine
40 Counterbalance Assembly
44 twine slots (4)
42 gravity rudder (two symmetrical parts: one on each end)
43 thumb hold (2)
41 finger grips (5)
45 body cylinder
50 twine tension vector
51 vertical (center of gravity) vector when the dish assembly is correctly oriented
52 horizontal vector representing the fin compression

DESCRIPTION OF INVENTION

Figure 1:
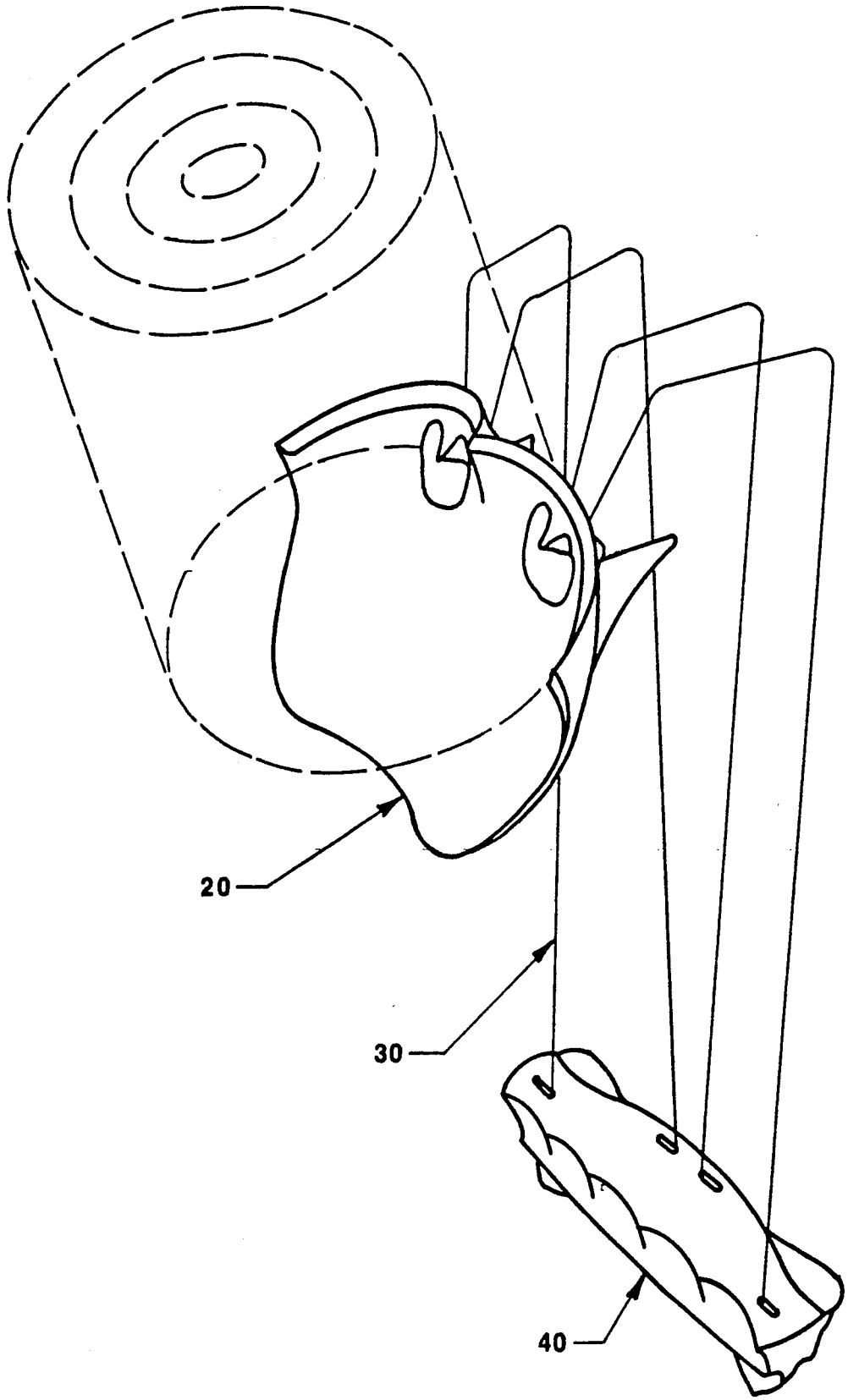
FIG. 1 is a phantom perspective of the implied target projected by the Target Arcs.
Figure 2:
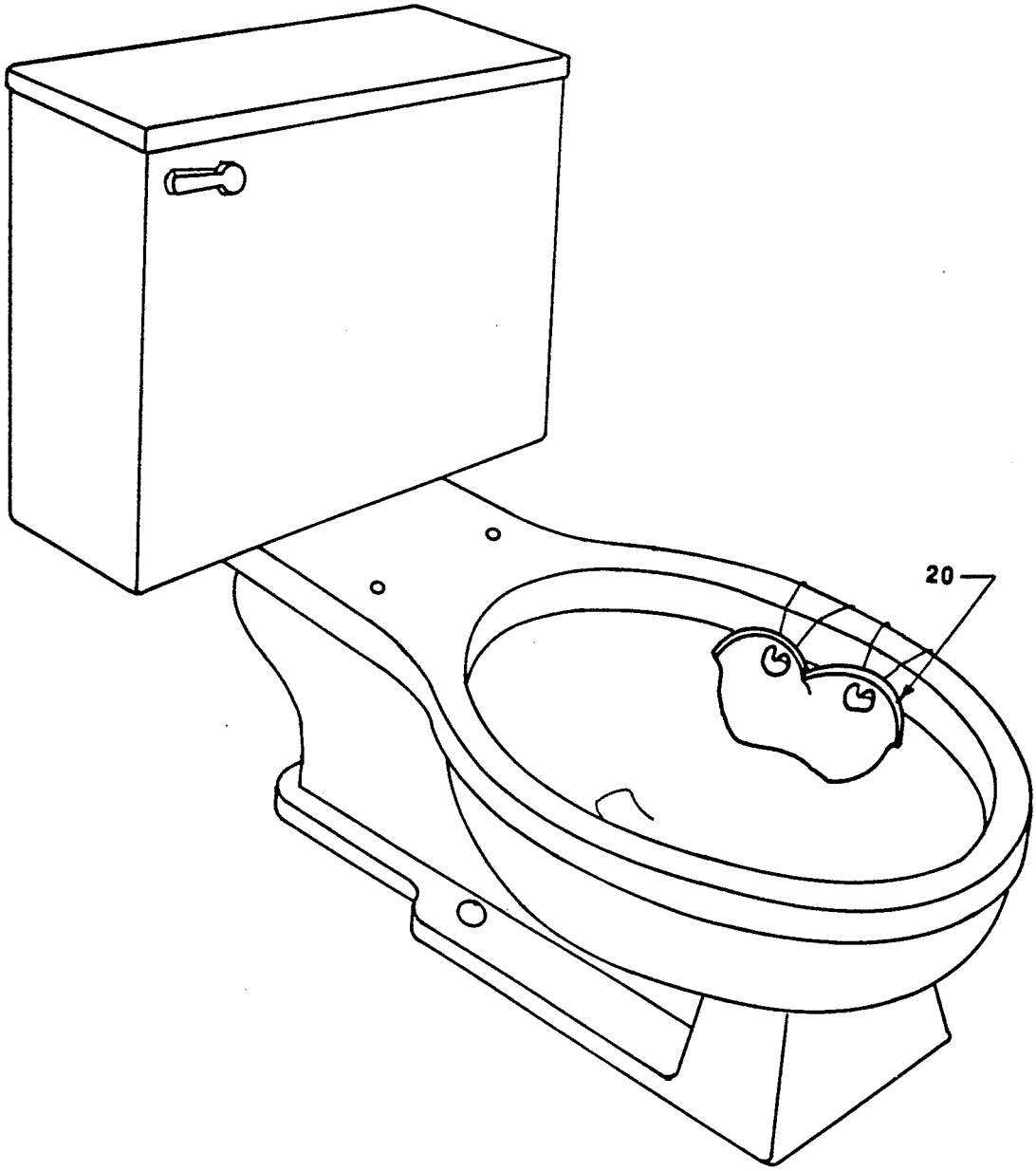
FIG. 2 shows a perspective view of the Toilet Bowl Silencer Dish draped over the toilet bowl rim in a properly installed configuration. (The toilet seat is left out of the illustration to avoid cluttering).

The Toilet Bowl Silencer Dish is shown mounted for use in FIG. 2. Disassembled it consists of three separate parts: the Dish Assembly (20), the Twine (30), and the Counterbalance Assembly (40). See FIG. 1.

The three elevations of the dish are shown in FIGS. 5A (side), 5B (front), and 5C (top). Because the many smooth curving shapes are difficult to illustrate, a rear elevation is shown in FIG. 5D with an additional sectional view. The dish is designed to be manufactured by pouring ceramic clay slip into a two piece mold. The finished product will be a smooth glazed arcuated disc or plate. The dish consists of four parts: an arcurated disc (21), two target arcs (24), two hang rings (23), and two fins or splash fins (22).

The arcuated disc (21) is the large area of the dish that accepts the falling column of liquid. The arcuated disc will have its concaved side facing the center of the toilet bowl and the convexed side facing toward the inside wall. The front view (FIG. 5B) shows a relatively large radius of curvature on the bottom edge to prevent the snagging of solid waste. The top view (FIG. 5C) shows a curvature of the concave disc that follows the flow of circulating water during the flush of the toilet. FIG. 5C also shows an inward curve along the bottom edge which is necessary to assure that the dish remains within the "volume of non-use". FIGS. 5B and 5C show sectional views of the vertical curvature which is designed to prevent falling liquid from spattering beyond the rim of the toilet bowl. A straight dashed line is used to represent a falling column of liquid. See FIGS. 10, 12, and 5B. The curvature of the dish is shaped to receive a falling column of liquid at a predetermined angle of incidence. This predetermined angle, when projected on two vertical perpedicular planes, strikes the concave disc at no greater than a 55 degree angle to each plane. This results in a maximum tangent plane angle of incidence of 55 degrees. See FIG. 10 (sectional view with arrow) on sheet #4 and FIG. 12 (sectional view with arrow) on sheet #5. Then the deflected liquid could be represented by another line reflecting into the toilet bowl water.

These angles could be explained from a physical standpoint. The curvature is based upon the fact that travelling objects striking a hard flat surface have a tendency to deflect from the hard surface at an angle equal to the angle of incidence. Although this reflective phenomenon is not exactly the case with low viscosity liquids at large angles, experiment has shown that moving liquids incident at angles of 55 degrees or less do not spatter and tend to deflect uniformly. Therefore, the builder of the dish must keep in mind the angle of incidence of the falling stream of liquid. He or she must make the curvature of the arcuated disc such that the trajectory of the falling column of liquid meets the expected point of contact at no greater than 55 degrees to the plane of the disc. This should be assessed by remembering that the trajectory line should be less than 45 degrees with the vertical direction. Finally, an attempt is made to keep the final shape similar to the curve of the toilet bowl. As will be seem in the operation section, the user will be positioned to establish a predetermined angle of incidence.

The top portion of the dish supports a shape of two angled arcs (24). See FIG. 5C. The purpose of these arcs is to guide the user to assume the correct angle of incidence i.e. to direct the falling column of liquid. It should be noted here that there exists a physiological capability of the male gender to exhibit a reasonable degree of marksmanship. There is also a psychological tendency to visualize a complete shape when given a partial shape. Hence, each arc on the top of the dish represents a circumference segment of a ten centimeter in diameter disk oriented in the plane perpendicular to the falling column of liquid. This is the target. See FIG. 1. The builder of the dish could cut a four inch diameter disk out of any flat thin material including stiff paper. This disk would then be used to establish the angle of the arc and, consequently, the incident angle and contact point of the falling column of liquid. The dish may be placed on either the left or the right side of the toilet bowl. Obviously the arcs must compliment each other so that there will exist a virtual target for either of the two possibile dish positions.

The two hang rings (23) allow the dish to hang on the inside of the toilet bowl without swaying from side to side. They also allow self adjusting so that the same dish angle is maintained independently of the angle of the twine. See FIGS. 6A through 6D. The hang rings must be sculptured meticulously. Based upon a two dimensional vector plane, the mechanics of the construction is easy to visualize. In order to keep the dish at a designed hang angle, the vertical vector must represent the weight of the dish assembly. Then any horizontal force will be accounted for by the angle of the twine. The twine tension has a vertical component, the weight, and a horizontal component, the splash fins compressed against the inside toilet bowl wall. See FIG. 6E on Sheet #8. The hang ring is located such that the force vector representing the twine which holds the weight and side load of the dish, will intersect its horizontal and vertical component vectors at the same point continuously. This intersection is a virtual location in line with the top ridge of the splash fin and the center of gravity of the specially designed dish. This virtual point will be maintained at the center of a circle described by the hang ring radius of curvature. The hang ring is a one-eighth segment of a toroid whose radius is the distance from the virtual location of the intersection of the twine tension component vectors to the inside surface of the hang ring. Since the smooth inside surface of the hang ring will be relatively frictionless, the twine tension vector will always pass through this center of the circle. Holes on either side of each ring are made large enough to allow full operation of the twine in its various positions. The inside curves of the rings are smooth and sloped to allow the twine to slide along the inside arch according to the angle from the inside of the toilet bowl rim. The ring arch is shaped so that the dish can be produced from a two piece mold.

The splash fins (22) assure that the dish target area will rest 8 cm or 3 inches inside of the toilet bowl inside wall. See FIGS. 6A through 6D. They are shaped to deflect water without displacing the dish position. For manufacturing convenience, the fins are thin to allow faster time drying and firing. For the benefit of the two piece mold the fins are tapered and protrude in a direction perpendicular to the mold separation plane. The slip may be poured in one fin void while displaced air escapes through the other fin void.

The twine (30) provides the means to drape the Toilet Bowl Silencer Dish over the toilet bowl drain rim. See FIG. 1. The waterproof twine is simply 142 cm or 56 inches of eight pound test monofiliment which can be purchased anywhere sport fishing supplies are sold. Minimum strength of the twine should be four times the weight of the dish. The dish will hang with a vertical force of its weight plus the horizontal force of the fins against the inside surface of the toilet bowl. The twine will be subjected to dynamic forces when the dish is picked up with the counterbalance and when the loose twine suddenly tightens when the dish is picked up from a dry resting place. This dynamic force will be the inertial load and should be estimated to be four times the weight of the accelerating dish.

One 112 cm or 44 inch loop is threaded through the two hang rings of the dish and the four slots in the counterbalance. See FIGS. 7A thru 7G. A square knot is tied to secure the loop. The dish and counterbalance will now hang with almost equal tension on the four strands holding them in place. Because of the lack of integrity of a single knot in the slick fishing line, a second square knot is tied after wrapping the two 10 cm or 4 inch ends around the central part of the counterbalance body cylinder. By stringing the second loop through an outside center twine slot, it cannot slip off the counterbalance. The secondary knot will also prevent the primary knot from migrating into the toilet bowl where it would retain urin.

The counterbalance has five parts: four twine slots (44), two gravity rudders (41), and a body cylinder (45) with thumb (42) and finger grips (43). See FIGS. 5A thru 5D on sheets #4 thru #7 respectively. It is made of the same ceramic ware as the dish and weighs approximately the same. Like the dish, the counterbalance is shaped to be poured in a two piece mold. See FIGS. 14 and 16. For this reason the gravity rudder is tapered narrow at the bottom and the twine slots are tapered narrow at the top. In addition, the counterbalance must be dried and fired at the same rate as the dish assembly. This means that it can have no extra thick areas which would require longer drying and firing times. Note that the body cylinder (45) is almost hollow. See FIGS. 11, 13, 14, and 16. The slots for the twine are relatively large to prevent wet glaze film from plugging them and to make assembling easier. The under side of the body cylinder has hollow tapered grooves to maintain thickness restrictions. The gravity rudders are tapered and protrude at the ends to allow easy and secure gripping. The thumbs (42) and finger grips (43) aid in a safe grasp and remind the user that the Toilet Bowl Silencer Dish is easily removed. The counterbalance generally hangs out of sight therefore physical appearance was not the foremost consideration in its design.

Although most dish and counterbalance pieces will be glazed with white glaze, many modern bathrooms are decorated in glazed colors. Happily, the Toilet Bowl Silencer Dish can be glazed to match these colors.

OPERATION

The Toilet Bowl Silencer Dish provides a non-vibrating medium that allows the user to avoid the direct vibration of the surface of the toilet bowl water. In essence the user is offered the almost vertical surface of a quiet urinal in contrast to letting fast moving liquid directly vibrate the water. The dish splash fins rest solidly against the inside wall of the toilet bowl while the twine tied to the counterbalance holds it up vertically. See FIG. 2. The proper position is reached by pulling slightly up or down on the counterbalance until the top ridge of the splash fins are horizontal.

The always present unobstructed area in front of the toilet bowl extends to the user the latitude to stand to either side of the center. See FIGS. 4A and 4B. This diagram and the target arc will assist the user in gaining an optimal trajectory. It should be observed here that low viscosity liquid under pressure that is allowed to flow out of a tube does not continue to maintain the exact shape of the excreting tube. In particular, there will be a well behaved visually controllable column of falling liquid and also droplets fanning out from this central column. In order to keep all of these droplets inside of the toilet bowl the user is positioned on the opposite side of the bowl rim where the dish is mounted. The concave curvature of the dish provides a desireable angle of contact with the falling column of liquid. This angle allows the toilet bowl to capture the volume of droplets around the falling stream. Conversely, if the user were to stand on the same side of the toilet bowl as that of the dish, he would gain a good angle of less than 55 degrees with the target dish but the droplets that fan out from the falling column of liquid would miss the toilet bowl and land on the floor. Moreover, the center of the target is located approximately 8 cm (3 in.) in from the outside toilet bowl rim and approximately 8 cm (3 in.) below it to keep the central column away from the edge.

The reason that the Toilet Bowl Silencer Dish accomplishes its purpose so completely is a curious combination of physical behavior. Firstly, it is known that a few drops of liquid falling into the toilet bowl water from a height of 38 cm (15 in.) produce negligible sound. In contrast, a large amount of drops in the form of the falling column of liquid whose velocity is increased by pressure from the bladder, significantly impacts the toilet bowl water surface. The resulting sound is resonated within the toilet bowl walls and sends the molecular vibrations along structures, through the plumbing, and even through closed bathroom doors. Interestingly, this time of maximum flow of falling liquid is precisely the time of maximum accuracy. In other words, the marksmanship of the user is at its best when the flow is most energetic. Fortunately the Toilet Bowl Silencer Dish becomes an easily attainable target at this time of maximum flow. Similarly, when the magnitude of the flow energy drops, the accuracy of the marksman fades. But this is when the decreasing kinetic energy in the falling liquid ceases to produce sound. Hence the user need not worry about being on target at every instant. To put it bluntly: "If you can't stay on target then your probably not making any noise".

Another related problem of high speed drops of liquid colliding with air to liquid surfaces is splashing. As the receiving surface is distorted it tends to recoil back so rapidly that droplets of liquid are thrown high in the air. For example, a shower curtain will become offensively soiled when located adjacent to a toilet bowl that is used by an adult male. Since the Toilet Bowl Silencer Dish redirects the energy of these high speed drops along its surface, this splashing beyond the rim is curtailed.

The purpose of the Twine (30) is to provide a flexible connection between the dish and the counterbalance. It stablizes both hanging objects by threading twice through both the dish and the counterbalance. Then the twine is tied to make one large loop. This puts equal tension on the four strands that drape over the toilet bowl rim. See FIG. 1. Both the dish and the counterbalance are then held in place by the friction between the four strands and the top edge of the toilet bowl rim. Because the strands are of equal tension the dish and the counterbalance remain in the exact position which they are placed. The user chooses which side of the toilet bowl to place the Toilet Bowl Silencer Dish (FIGS. 4A and 4B) and simply drapes the assembly on the rim. No special skills are required to install the Toilet Bowl Silencer Dish. The angular orientation of the dish will adjust automatically because of the center of gravity created by the location of the molded hang rings. The installer should let the dish hang such that the falling liquid contact target area is 8 cm (3 in.) below the top of the rim. It does not matter whether the bottom of the dish is submerged in the toilet bowl water or completely out of the water. As stated above, the splash fins should be horizontal. Although unlikely, it is possible that both splash fins could be located directly beneath some toilet bowl drain rim drain holes. If this happens, the Toilet Bowl Silencer Dish may vibrate during the flush. To stop the vibration, simply position the dish either slighly more toward the front or slightly more toward the back of the toilet bowl.

Although twine replacement is not anticipated, monofiliment line can be strung according to FIGS. 7A thru 7G. The first square knot joins the twine into a loop that would be 112 cm (44 inches) in circumference if the twine could be layed out in a circle. This first knot is shown tied in a location that is half way between the two end twine slots. See FIG. 7F. There are two 13 cm (5 inch) lengths of twine left over after the first square knot is tied. One of these 13 cm lengths is to be strung through one of the center twine slots and then a second square knot is to be tied. After the second square knot is tied, there should be equal 2.5 cm (1 inch) lengths left. This second loop, which runs through one of the center twine slots, would be 20 cm (8 inches) in circumference if it could be layed into a circle. See FIG. 7G. This second loop is the safety loop. The safety loop has two purposes. One is to act as a back up square knot to the first square knot. If the first square knot is tied wrong, the slick monofiliment twine will slip when the Toilet Bowl Silencer Dish is picked up. This would cause the dish to fall away from the counterbalance and break against the toilet bowl or the floor. The second purpose of the safety loop is to keep the first square knot from migrating away from the counterbalance. Remember that the first square knot is part of a large loop and it could reposition itself while the dish and counterbalance remain in their correct positions. This means that the first square knot could work its way into the toilet bowl at a place where it could not be rinsed. While this is not a very serious situation, it would be nice if the square knots could stay out of the toilet bowl and stay in the area of the counterbalance. Thus the second square knot creates a second loop that keeps both square knots in the vicinity of the counterbalance. This second loop must remain loose at all times. As the first square knot migrates the second, smaller, loop streches out taut. When this happens, the first square knot cannot move further, the large loop cannot maintain even tension on the draped twine and the counterbalance may hang crooked. This could lead to the dish hanging crooked. Should this happen, simply put your finger through the small loop of twine at the center of the counterbalance (FIG. 7G) and pull the twine until the small loop hangs loose around the center of the counterbalance body cylinder. This draws the first square knot to the central area of the counterbalance where the tension on all of the suspension lines becomes equal.

One of the more pleasant features of the Toilet Bowl Silencer Dish is the ease of cleaning. The counterbalance acts as a handle. By reaching down and grasping the counterbalance then raising it, the entire assembly becomes undraped and the dish lifts out of the toilet bowl. At this time the dish may be dunked into the clean toilet water for rinsing which should be all that is necessary. If further cleaning is required, usually a slight brush with a piece of paper towel will accomplish the task without having to handle the dish. Caution: lower the dish very slowly into the clean toilet water. If the dish is inadvertently slammed against the toilet bowl it may chip or break. Should this happen, reach your hand into the clean toilet water and retrieve the broken piece of dish. If the broken piece is not retrieved it may impair normal sewer flow.

Sometimes the splash fins are not able to distribute flushing water over the dish. This is not a serious problem however, urea salts will build on the surface of the dish and release a detectible odor after two weeks. If this happens simply grasp the counterbalance and slowly dunk the dish in the clean toilet water. These urea salts are water soluble and dissolve immediately. Then redrape the Toilet Bowl Silencer Dish assembly.

When cleaning the toilet, pick up the Toilet Bowl Silencer Dish by the counterbalance, rinse it in the clean toilet bowl water, and then set it very gently on the floor. Lay it concave face up with the twine streched to full length to the counterbalance. By keeping the twine taut the twine will not become twisted or entangled. Should the twine become hopelessly entangled, it may become necessary to untie the two square knots and restring as shown in FIGS. 7A thru 7G.

The Toilet Bowl Silencer Dish is made of ceramic clay. Both the dish and the counterbalance are glazed to attain a smooth glass like finish over their entire surface. This finish renders the parts sanitary, easily cleanable, and maintenance free. Since the dish, twine, and counterbalance are assembled at the manufacturing site, the purchaser will not need to read lengthly instructions.

Most users will be able to look at FIG. 2 and install the Toilet Bowl Silencer Dish without further instruction. The male user will psychologically perceive the target arc circle and use the dish without instruction. Since the Toilet Bowl Silencer Dish is sanitary and maintenance free except for occasional cleaning, no special instructions are required to maintain it. The Toilet Bowl Silencer Dish was designed to appeal to the consumers desire for simplicity.

SPECIFICATION CONCLUSION

The requirements for a device that suppresses the noise of liquid agitating liquid in the common household bathroom toilet bowl evolved chronologically. The initial requirement was introduced at a condominium association meeting. As is the case with most engineering projects, the first specification leads to new requirements which, in turn, lead to more specifications. The final set of requirements must encompass the production of a single device that can be offered to the public for attachment to any common household bathroom toilet. In addition to inventing a device to redirect the falling liquid energy, it was also necessary to invent a method of attachment. It was imperative that the product be absolutely sanitary. The discovery of the fishing leader to serve as the suspension device material was a superb solution. It blended well with the sanitation stipulation that encouraged the use of glazed ceramic parts. The final stage of development was validation. It was difficult to be assured that an object could be inserted into the toilet bowl without snagging solid waste during a flush. The Toilet Bowl Silencer Dish passed a rigorous set of tests under all anticipated conditions. Its location not only keeps it out of harms way but this particular toilet bowl area is natural to use. The user will find this accessary a satisfying convenience.

SUMMARY

Many people recognize the need for a toilet that accomodates the male user. Up until now, society has had to accept the fact that a gentleman, when using the toilet, can be heard from adjoining rooms. It has also been accepted that nothing could be done about the splashing mixture of water and urin spattering the vicinity of the toilet. The toilet Bowl Silencer Dish eliminates both of these dilemas. Only after the designed assembly was built and tested was it realized that this toilet bowl accessary was a complete solution. In stepping back and observing the mounted assembly, it could be perceived as a urinal of exactly the right size in a minimal sized area with an ideal orientation. Someday it may eliminate the need for expensive urinals in some public and private facilities.

It is anticipated that the Toilet Bowl Silencer Dish will enhance the quality of modern living.

I claim:

1. A urine splash guard accessary for a male user of a conventional flush toilet having a bowl containing a normal water level therein and including an inner and outer surface and an upper rim, said accessary comprising:

a first arcuate disc of rigid material having a generally concave front surface and a generally convex rear surface and further including at least one fin integral with and extending rearwardly from said rear surface at a top portion thereof;

at least one hanger member integral with said rear surface of said disc at said top portion thereof and positioned above said at least one fin;

a length of twine secured at one end to said at least one hanger member;

a counterbalance secured to the other end of said twine; and said disc adapted to be positioned within the toilet bowl above the normal water level therein with its front surface facing toward the center of the bowl and with said at least one fin engaging the inner surface of the bowl below the rim thereof, wherein said twine is draped over the rim of the bowl with said counterbalance freely hanging alongside the outer surface thereof thereby maintaining said disc in position, whereby a male user of the toilet can direct a stream of urine at said concave front surface of said disc to reduce any splash or noise normally generated thereby.

2. An accessary as defined in claim 1 wherein said concave front surface of said disc allows flush water to flow thereover.

3. An accessary as defined in claim 1 wherein said counterbalance and said disc are of substantially the same weight.

4. An accessary as defined in claim 1 wherein said at least one hanger member is in the form of a portion of a circular arc.

5. An accessary as defined in claim 1 wherein said disc is made of glazed ceramic clay.

6. An accessary as defined in claim 1 wherein said length of twine is waterproof and has a minimum tensile strength of four times the weight of said disc.

7. An accessary as defined in claim 6 wherein said length of twine is commercially available monofilament.

8. An accessary as defined in claim 1 further comprising:

a second arcuate disc substantially identical to said first arcuate disc, said second disc including at least one fin integral with the rear surface thereof and positioned thereon substantially identically to said at least one fin of said first disc, said first and second discs being integrally attached in a side-by-side relationship defining a double breasted dish;

at least one hanger member integral with the rear surface of said second disc and positioned thereon substantially identically to said at least one hanger member of said first disc; and a second length of twine secured at one end to said at least one hanger member of said second disc and secured at the other end to said counterbalance.

9. An accessary as defined in claim 8 wherein the front surface of said double breasted dish allows flush water to flow thereover.

10. An accessary as defined in claim 8 wherein said counterbalance and said double breasted dish are of substantially the same weight.

11. An accessary as defined in claim 8 wherein said hanger members are in the form of a portion of a circular arc.

12. An accessary as defined in claim 8 wherein said double breasted dish is made of glazed ceramic clay.

13. An accessary as defined in claim 8 wherein said lengths of twine are waterproof and have a minimum tensile strength of four times the weight of said double breasted dish.

14. An accessary as defined in claim 13 wherein said lengths of twine are commercially available monofilament.

* * * * *